US006343725B1

(12) United States Patent
Lohrman

(10) Patent No.: US 6,343,725 B1
(45) Date of Patent: Feb. 5, 2002

(54) DISK-TYPE TOGGLE-ACTION DISPENSING CLOSURE, PACKAGE AND METHOD OF ASSEMBLY

(75) Inventor: Richard D. Lohrman, Sylvania, OH (US)

(73) Assignee: Owens-Illinois Closure Inc., Toledo, OH (US)

( * ) Notice: Subject to any disclaimer, the term of this patent is extended or adjusted under 35 U.S.C. 154(b) by 0 days.

(21) Appl. No.: 09/740,682

(22) Filed: Dec. 19, 2000

(51) Int. Cl.[7] ..... B67D 3/00

(52) U.S. Cl. ..... 222/536; 222/534; 222/533; 222/153.14

(58) Field of Search ..... 222/153.14, 498, 222/536, 533, 534

(56) References Cited

U.S. PATENT DOCUMENTS

| | | | | | |
|---|---|---|---|---|---|
| 4,022,352 | A | * | 5/1977 | Pehr | 222/153 |
| 4,095,725 | A | | 6/1978 | Goncalves | |
| RE29,793 | E | * | 10/1978 | Pehr | 222/153 |
| 4,487,342 | A | * | 12/1984 | Shy | 222/481.5 |
| 4,645,086 | A | * | 2/1987 | Rosenthal | 215/235 |
| 4,776,501 | A | * | 10/1988 | Ostrowsky | 222/517 |
| 4,867,399 | A | | 9/1989 | Dubach | |
| 4,962,869 | A | | 10/1990 | Gross et al. | |
| 5,201,440 | A | | 4/1993 | Gross | |
| 5,236,107 | A | * | 8/1993 | Spaanstra, Sr. | 222/534 |
| 5,284,264 | A | * | 2/1994 | Gross | 215/237 |
| 5,314,093 | A | * | 5/1994 | Gross et al. | 222/153 |
| 5,341,960 | A | * | 8/1994 | Lay | 222/153 |
| 5,346,100 | A | | 9/1994 | Lay | |
| 5,370,284 | A | * | 12/1994 | Dirksing | 222/534 |
| 5,622,284 | A | * | 4/1997 | Sawicki | 222/153.14 |
| 5,683,016 | A | * | 11/1997 | Santagiuliana | 222/153.14 |
| 5,709,318 | A | | 1/1998 | Oder | |
| 5,862,963 | A | | 1/1999 | Fuchs et al. | |
| 5,873,494 | A | * | 2/1999 | Dallas, Jr. | 222/129 |
| 6,029,866 | A | | 2/2000 | Wood et al. | |
| 6,152,329 | A | * | 11/2000 | Rosenthal | 222/153.14 |

FOREIGN PATENT DOCUMENTS

| | | | | |
|---|---|---|---|---|
| GB | 2231036 A | * | 11/1990 | B65D/47/08 |
| GB | 0589114 A2 | * | 3/1994 | B65D/47/20 |
| WO | 94/29184 | * | 12/1994 | B65D/47/08 |

* cited by examiner

*Primary Examiner*—Kevin Shaver
*Assistant Examiner*—Frederick C Nicolas

(57) ABSTRACT

A toggle-action dispensing closure includes a base having an upper edge, and internal thread or bead for securement to a container, and a recessed deck disposed beneath the upper edge and having a fluid dispensing opening. A dispensing disk or actuator is pivotally mounted to the base above the deck, and includes a seal for cooperating with the dispensing opening for selectively opening and closing the dispensing opening. A lug element on a periphery of the disk has a sharp edge in opposed abutment with the upper edge of the base to resist first movement of the actuator to open the dispensing opening. First movement of the actuator to open the dispensing opening causes permanent deformation at the upper edge of the base and/or at the lower edge of the element, such that the element and the edge present lesser resistance to opening of the actuator after such first opening.

2 Claims, 4 Drawing Sheets

DISK-TYPE TOGGLE-ACTION DISPENSING CLOSURE, PACKAGE AND METHOD OF ASSEMBLY

The present invention is directed to packages for dispensing fluid products such as body lotions, and more particularly to a disk-type toggle-action dispensing closure with a feature to prevent accidental opening of the closure during shipment to the consumer.

BACKGROUND AND SUMMARY OF THE INVENTION

Disk-top toggle-action fluid dispensing closures conventionally include a base for securement to the finish of a container and an actuator disk pivotally mounted on the base. The disk is pivotal between a closed position that closes a dispensing opening in the closure base, and an open position for dispensing fluid product from the container and closure package. A package of this type is illustrated, for example, in U.S. Pat. No. 5,862,963. The closure and package illustrated in this patent include an internal feature in abutment with the actuator disk to resist accidental opening of the actuator and package during shipment to the consumer. First depression of the actuator to open the package fractures this feature from the closure base. It is a general object of the present invention to provide a closure, a closure and container package, and a method of making a closure of the described type that include a feature for resisting initial opening of the actuator during shipment to a consumer, but which do not involve fracture of the feature from the closure.

A toggle-action dispensing closure in accordance with a presently preferred embodiment of the invention includes a base having an upper edge, and internal thread or bead for securement to a container, and a recessed deck disposed beneath the upper edge and having a fluid dispensing opening. A dispensing disk or actuator is pivotally mounted to the base above the deck, and includes a seal for cooperating with the dispensing opening for selectively opening and closing the dispensing opening, and a feature for resisting first movement of the actuator to open the dispensing opening. This feature comprises an element on a periphery of the disk having a sharp edge in opposed abutment with the upper edge of the base. First movement of the actuator to open the dispensing opening causes permanent deformation at the upper edge of the base and/or at the lower edge of the element, such that the element and the edge present a lesser resistance to opening of the actuator after such first opening. The deformation at the element and/or the upper edge of the base does not involve fracture of any portion from the base of actuator.

In the preferred embodiment of the present invention, the element on the actuator periphery is wedge-shaped, having a generally rectangular portion with a central axis, and a sharp point centered on the axis and extending from the rectangular portion into abutment with the upper edge of the closure base. This wedge-shaped element is entirely integral with a peripheral wall on the actuator. In the preferred embodiment, the rectangular portion has an upper edge that is sloped radially inwardly toward the periphery of the actuator so as not to interfere with the opposing edge of the closure base during pivoting of the actuator to the fully open position. Other aspects of the invention involve a method of making such a toggle-action dispensing closure, and a package that includes such a toggle-action dispensing closure secured to an external thread or bead on a container.

BRIEF DESCRIPTION OF THE DRAWINGS

The invention, together with additional objects, features and advantages thereof, will be best understood from the following description, the appended claims and the accompanying drawings in which:

DETAILED DESCRIPTION OF PREFERRED EMBODIMENTS

Figure 1:
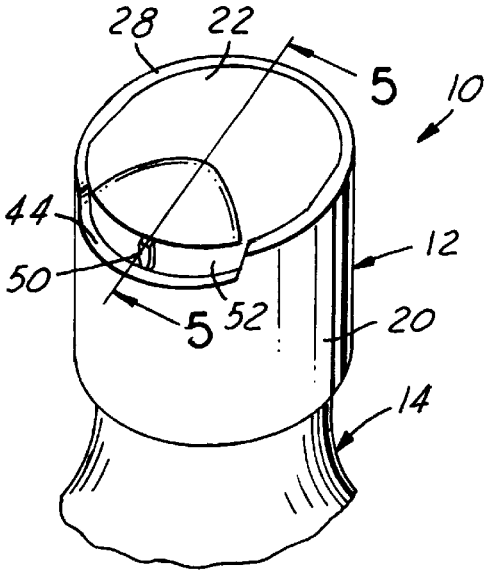
FIG. 1 is a fragmentary perspective view of a closure and container package that includes a disk-type toggle-action dispensing closure in accordance with a presently preferred embodiment of the invention.
Figure 2:
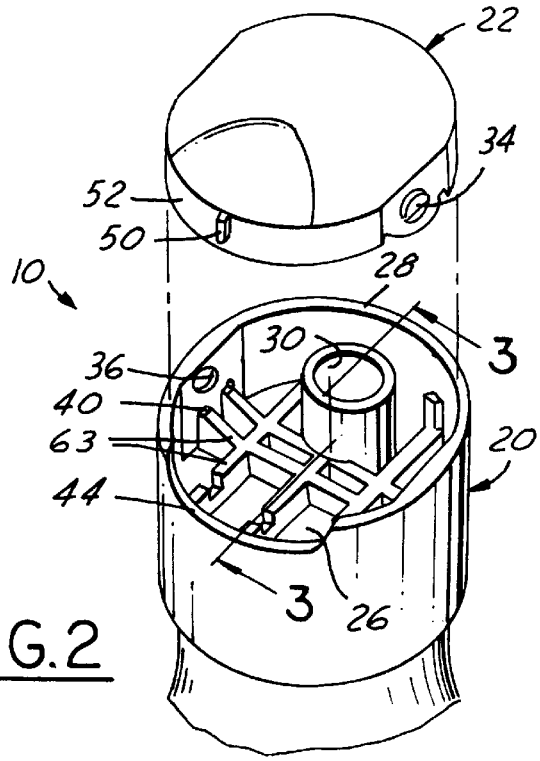
FIG. 2 is an exploded perspective view of the closure illustrated in FIG. 1.

FIGS. 1–5 illustrates a closure and container package 10 in accordance with a presently preferred embodiment of the invention as comprising a closure 12 assembled to the finish of a container 14. Container 14 maybe of any suitable construction, such as flexible resilient molded plastic, having a cylindrical finish 16 with an external thread or bead 18 for securement of closure 12 to container 14. Closure 12 includes a base 20 and a toggle-action actuator disk 22. Base 20 has a peripheral skirt 23 with an internal thread or bead 24 that cooperates with external thread or bead 18 on container finish 16 for securing closure base 20 to the container finish. A deck 26 is disposed beneath the upper edge 28 of base 20, and has a dispensing opening 30 for dispensing product from within the package. An annular wall 31 surrounds deck 26, terminating in base upper edge 28. Disk actuator 22 has a plug seal wall 32 that seals dispensing opening 30 in deck 26 in the closed position of the disk actuator illustrated in FIG. 5. Disk actuator 22 also has a pair of laterally extending trunnions 34 that are received in pockets 36 formed on the inner surface of closure base wall 31. Alternatively, trunnions 34 may be replaced by posts that extend through laterally opposed openings in base sidewall 31. Disk actuator 22 has a pair of bearing surfaces 38 disposed beneath and concentric with trunnions 34, which cooperate with bearing surfaces 40 on closure base 20 for supporting the disk actuator during opening and closing of the actuator. Disk actuator 22 also has a peripheral radially extending dispensing opening 42 through which product is dispensed from the container in the open position of the actuator illustrated in FIG. 5F, and edge 28 of base 20 includes a concave recessed portion 44 diametrically opposed in assembly with actuator dispensing opening 42 for manual pivoting depression of actuator 22. Closure base 20 and disk actuator 22 may be of any suitable molded plastic construction.

Figure 3:
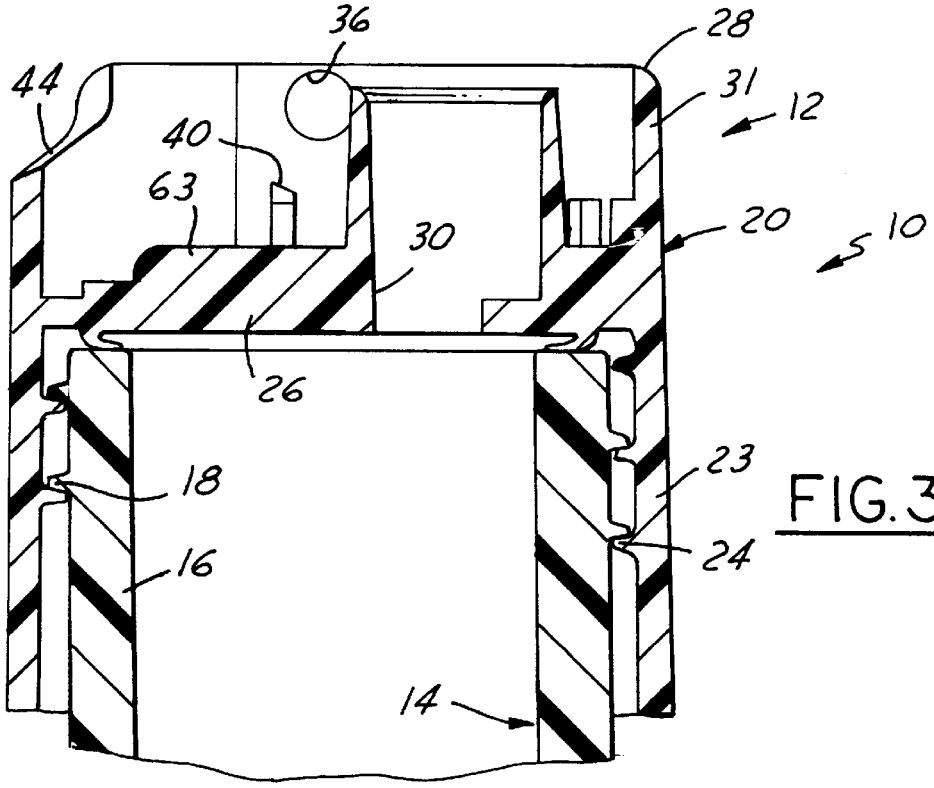
FIG. 3 is a fragmentary sectional view that illustrates the base of the closure in FIGS. 1 and 2 assembled to a container finish.
Figure 4:
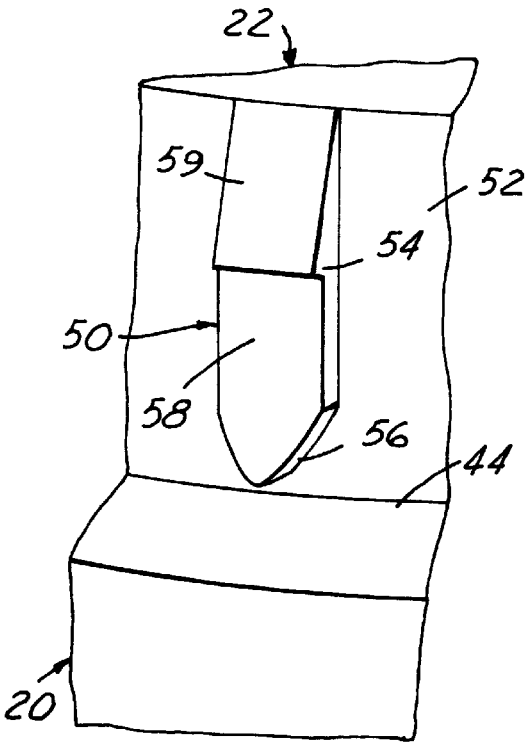
FIG. 4 is a fragmentary perspective view of the back edge of the closure in accordance with the invention.
Figure 7:
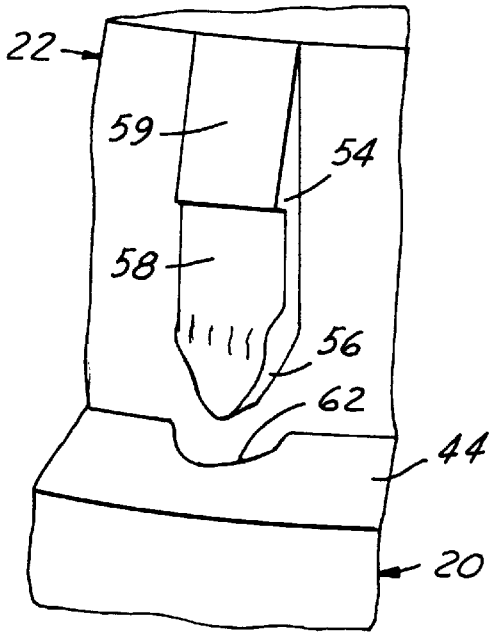
FIG. 7 is a fragmentary perspective view of the rear edge of the actuator disk and closure base after first opening of the actuator.
Figure 5:
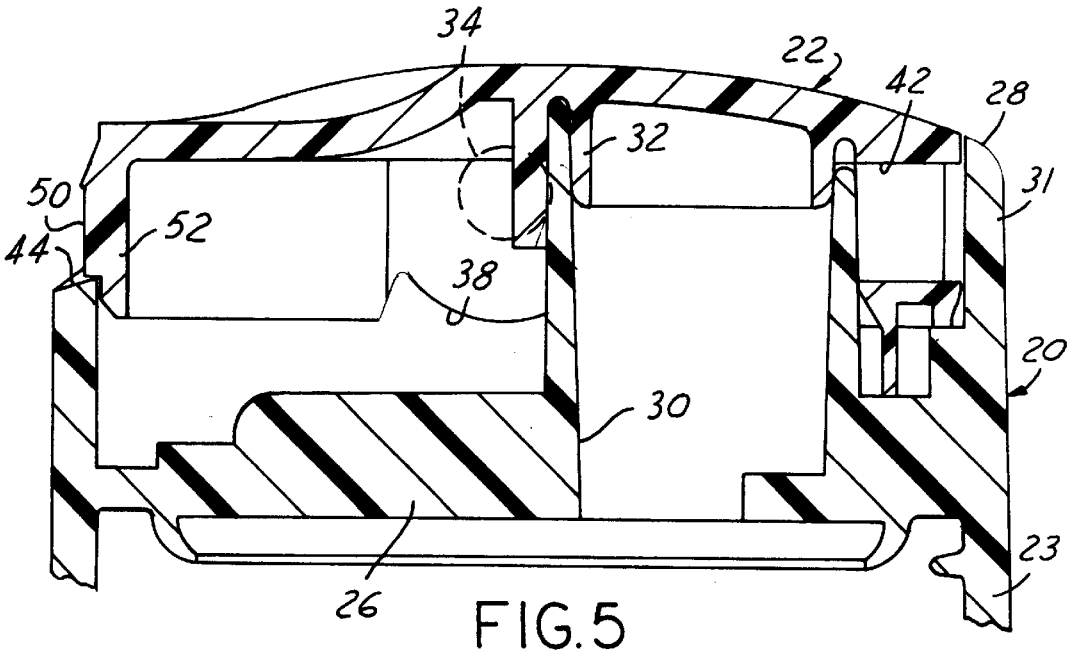
FIG. 5 is a fragmentary sectional view of the closure as supplied in the initial fully closed position.
Figure 5A:
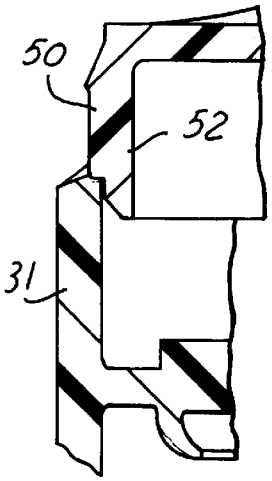
FIGS. 5A–5E are fragmentary sectional views of a portion of FIG. 5 that illustrate the dispensing actuator disk at successive stages of first opening of the disk.
Figure 5B:
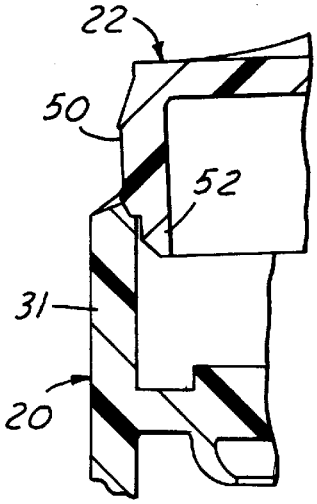
Figure 5C:
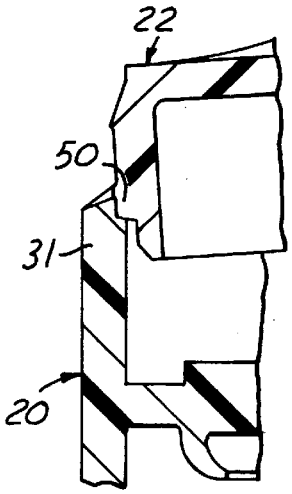
Figure 5D:
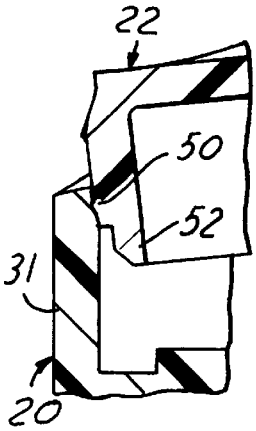
Figure 5E:
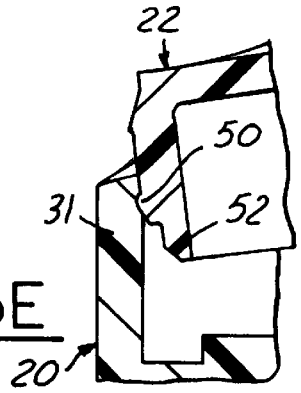
Figure 5F:
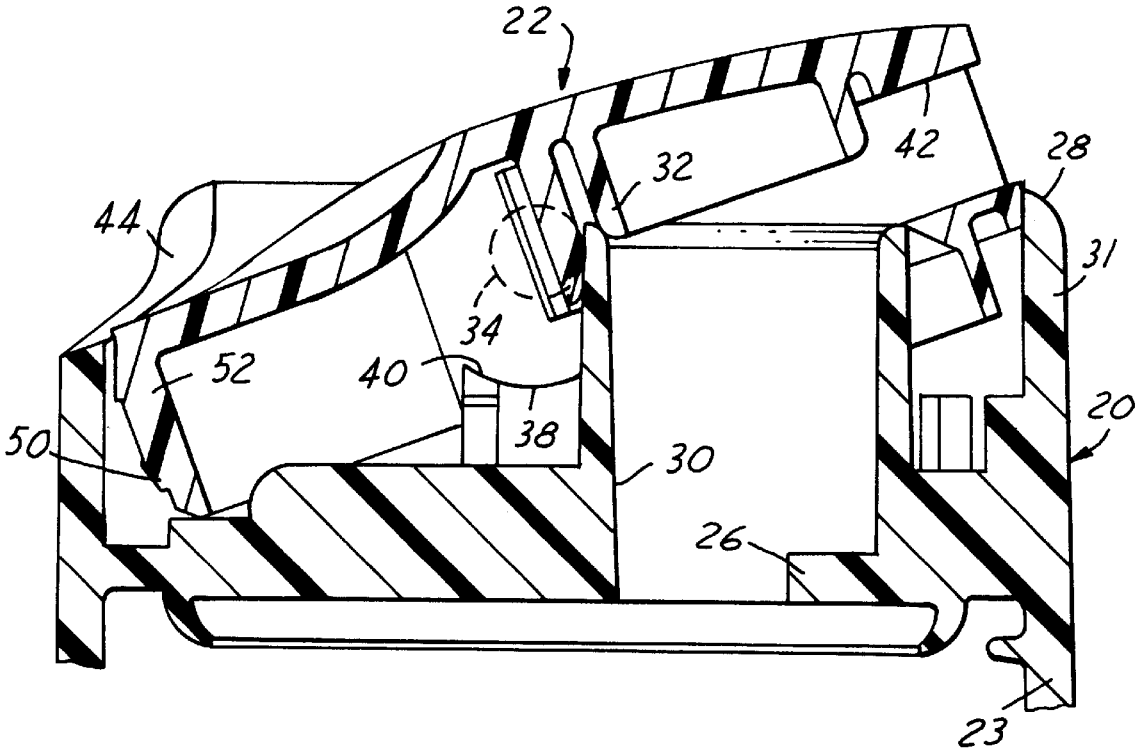
FIG. 5F is a sectional view similar to that of FIG. 5 but showing the dispensing actuator disk in the fully open position.

A lug element 50 is integrally molded on the skirt 52 of disk actuator 22, preferably at a position diametrically opposed to disk actuator dispensing opening 42. Lug element 50 has a generally rectangular upper portion 54 (in the orientation of the drawings) with a central longitudinal axis, and a pointed lower portion 56 concentric with such axis. Thus, as viewed from the radial direction, lug element 50 is of wedge-shaped geometry, having a sharp point opposed in assembly with recessed portion 44 of base upper edge 28. As best seen in FIGS. 3–5, upper edge 28 in recessed portion 44 is sloped downwardly and outwardly with respect to the axis of base 20. The radially facing surface 58 of lug element 50 is generally parallel to the central axis of the disk actuator in the lower portion of the lug element, and slopes at 59 radially inwardly and axially upwardly at the upper portion of the lug element so as to clear the opposing edge of the closure base sidewall in the filly open position of the actuator (FIG. 5F). Pointed end 56 of element 50 may have a symmetrical included angle of 60°—i.e., symmetrical about the centerline of element 50 as previously described.

Figure 6A:
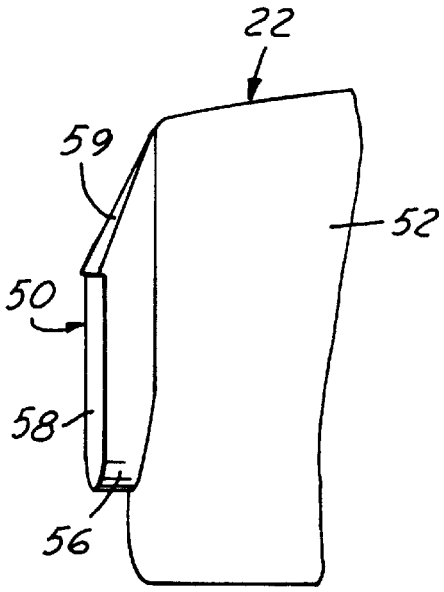
FIG. 6A is a perspective view of the rear edge of the actuator disk as initially fabricated.
Figure 6B:
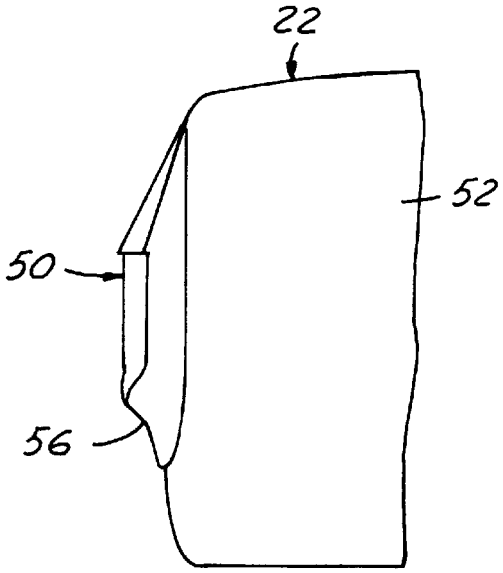
FIG. 6B is a fragmentary view similar to that of FIG. 6A but showing the rear edge of the actuator disk after first opening of the actuator.

In assembly, the lower pointed edge of lug element 50 is disposed closely adjacent to or in abutment with upper edge 28 of the closure base. The radial dimension of lug element 50 is such that there is interference between the lug element and the upper edge of the closure base, as best seen in FIG. 5, which prevents accidental opening of the actuator during shipment and handling of the closure and package prior to delivery to the consumer. The consumer may initially open the package by pressing downwardly on the edge of the actuator overlying recessed portion 44 of the closure base. During such depression, there is interference between the closure base and lug element 50 on the edge of the actuator. Lug element 50 digs into the closure base edge and/or the closure base edge radially deforms the pointed end of the lug element through the successive stages of initial depression illustrated in FIGS. 5A–5E. When the actuator is pivotally depressed to the fully open position illustrated in FIG. 5F, pointed end 56 of lug element 50 is permanently deformed as illustrated in FIG. 6B and/or a divot 62 is permanently formed in portion 44 of base upper edge 28. This permanent deformation assures that lug element 50 will have less influence on further opening of the dispensing closure during normal use by the consumer. Whether lug element 50 or closure base portion 44, or both, are permanently formed will depend upon the relative hardnesses of the molded plastic base 20 and actuator 22. In a presently preferred embodiment of the invention, both components are molded of polypropylene. The upper surface of closure base deck 26 has a plurality of crossed support ribs 63 for providing additional strength to the closure base.

There have thus been disclosed a toggle-action dispensing closure, a closure and container package, and a method of fabricating such a closure, that fully satisfy all of the objects and aims previously set forth. In particular, initial opening of the closure is resisted so as to seal the closure during handling and shipment to the ultimate consumer. The ultimate consumer may readily open the package, but without fracturing any portion of the closure that may become lose within the closure or dispensed with product. The invention has been disclosed in conjunction with a presently preferred embodiment thereof, and a number of modifications and variations have been suggested. Other modifications and variations will readily suggest themselves to persons of ordinary skill in the art. The invention is intended to embrace all such modifications and variations as fall within the spirit and broad scope of the appended claims.

What is claimed is:

1. A toggle-action dispensing closure that includes:

a base having a skirt with internal means for securement to a container finish, an upper edge with a recessed portion, and a deck recessed beneath said upper edge and having a dispensing opening, and a dispensing actuator pivotally mounted to said base above said deck, said dispensing actuator including an outlet at a periphery of said actuator diametrically opposite said recessed portion of said base upper edge, a seal for cooperating with said dispensing opening for selectively opening and closing said dispensing opening, and an element extending radially outwardly from a periphery of said actuator adjacent to and overlying said recessed portion of said upper edge and diametrically opposite said outlet, said element, as viewed from radially outwardly of said closure, including a rectangular upper portion with a central axis and a triangular lower portion centered on said axis and terminating in a point adjacent to said recessed portion of said upper edge, first movement of said actuator to open said dispensing opening causing permanent deformation at said upper edge of said base and/or said point of said element, such that said element and said upper edge present reduced resistance to opening of said dispensing opening after said first movement.

2. The closure set forth in claim 1 wherein said rectangular portion of said element has an upper that slopes radially inwardly toward said periphery of said actuator.

* * * * *